US007418931B2

(12) United States Patent
Sugie et al.

(10) Patent No.: US 7,418,931 B2
(45) Date of Patent: Sep. 2, 2008

(54) ELECTROMAGNETICALLY DRIVEN VALVE

(75) Inventors: Yutaka Sugie, Nishikamo-gun (JP); Masahiko Asano, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 87 days.

(21) Appl. No.: 11/492,772

(22) Filed: Jul. 26, 2006

(65) Prior Publication Data

US 2006/0260571 A1 Nov. 23, 2006

(30) Foreign Application Priority Data

Aug. 2, 2005 (JP) ..... 2005-224418

(51) Int. Cl.
*F01L 9/04* (2006.01)

(52) U.S. Cl. ..... 123/90.11; 251/129.07; 251/129.09; 251/129.15

(58) Field of Classification Search ..... 123/90.11
See application file for complete search history.

(56) References Cited

U.S. PATENT DOCUMENTS

| | | | | |
|---|---|---|---|---|
| 5,772,179 | A | 6/1998 | Morinigo et al. | |
| 6,089,197 | A | 7/2000 | Lange et al. | |
| 6,467,441 | B2 | 10/2002 | Cristiani et al. | |
| 6,481,396 | B2 * | 11/2002 | Stolk et al. | 123/90.11 |
| 6,516,758 | B1 * | 2/2003 | Leiber | 123/90.11 |
| 6,546,704 | B1 | 4/2003 | Marchioni et al. | |
| 6,546,904 | B2 * | 4/2003 | Marchioni et al. | 123/90.11 |
| 2001/0054401 | A1 | 12/2001 | Christiani et al. | |
| 2002/0020372 | A1 | 2/2002 | Stolk et al. | |
| 2002/0057154 | A1 | 5/2002 | Keck | |
| 2002/0069842 | A1 | 6/2002 | Curtis et al. | |
| 2004/0011310 | A1 | 1/2004 | Sugimoto et al. | |
| 2005/0076866 | A1 * | 4/2005 | Hopper et al. | 123/90.11 |

FOREIGN PATENT DOCUMENTS

| | | | |
|---|---|---|---|
| DE | 199 55 079 | A1 | 5/2000 |
| DE | 100 00 045 | A1 | 7/2001 |
| DE | 100 25 491 | A1 | 12/2001 |
| DE | 100 53 596 | A1 | 5/2002 |
| DE | 102 20 788 | A1 | 11/2003 |
| DE | 102 21 015 | A1 | 11/2003 |
| DE | 102 23 673 | A1 | 12/2003 |
| DE | 102 26 010 | A1 | 12/2003 |

(Continued)

OTHER PUBLICATIONS

Extended European Search Reports dated Nov. 24, 2006, Dec. 11, 2006 (3) and Dec. 12, 2006 (2).

(Continued)

*Primary Examiner*—Thomas Denion
*Assistant Examiner*—Kyle M Riddle
(74) *Attorney, Agent, or Firm*—Kenyon & Kenyon LLP

(57) ABSTRACT

An electromagnetically driven value includes a valve element that has a valve stem and that reciprocates in a direction in which the valve stem extends; a disc that extends from a driving end, which is operatively linked with the valve stem, to a pivoting end, and that pivots around a central axis which extends along the pivoting end; and a nonmagnetic body that is arranged between the disc and the valve stem.

9 Claims, 9 Drawing Sheets

FOREIGN PATENT DOCUMENTS

| | | | |
|---|---|---|---|
| EP | 1 036 964 | A1 | 9/2000 |
| EP | 1 087 110 | A1 | 3/2001 |
| EP | 1 136 660 | A1 | 9/2001 |
| EP | 1 152 129 | A1 | 11/2001 |
| EP | 1 170 469 | A1 | 1/2002 |
| EP | 1 209 328 | A2 | 5/2002 |
| FR | 2 812 026 | | 1/2002 |
| FR | 2860912 | | 4/2005 |
| WO | WO 00/29722 | | 5/2000 |
| WO | WO 2006/018931 | A1 | 2/2006 |

OTHER PUBLICATIONS

Chinese Language Version of Chinese Office Action, Appln. No. 200610107568.9 dated Oct. 12, 2007.

English Translation of Chinese Office Action, Appln. No. 200610107568.9 dated Oct. 12, 2007.

European Search Report issued to EP Appln. No. 06 01 5550.4 dated Dec. 18, 2007.

* cited by examiner

ELECTROMAGNETICALLY DRIVEN VALVE

INCORPORATION BY REFERENCE

The disclosure of Japanese Patent Application No. 2005-224418 filed on Aug. 2, 2005 including the specification, drawings and abstract is incorporated herein by reference in its entirety.

BACKGROUND OF THE INVENTION

1. Field of the Invention

The invention relates to an electromagnetically driven valve. More specifically, the invention relates to a pivot-type electromagnetically driven valve that used in an internal combustion engine, and that is driven by elastic force and electromagnetic force.

2. Description of the Related Art

An electromagnetically driven valve is described, for example, in U.S. Pat. No. 6,467,441.

The electromagnetically driven valve mounted in an actual machine needs to be both high-powered and compact (i.e., mountability is good). However, an increase in the power of the electromagnetically driven valve results in an increase in size. Conversely, reduction in size prevents an increase in power. Accordingly, an increase in power and reduction in size are not compatible with each other.

SUMMARY OF THE INVENTION

It is an object of the invention to provide an electromagnetically driven valve that is both high-powered and compact (i.e., mountability is good).

A first aspect of the invention relates to an electromagnetically driven valve that is driven by electromagnetic force. The electromagnetically driven valve includes a valve element that has a valve shaft and that reciprocates in the direction in which the valve shaft extends; a oscillating member that extends from a driving end, which is operatively linked with the valve shaft, to a pivoting end, and that pivots around a central axis which extends along the pivoting end; and a nonmagnetic body that is arranged between the oscillating member and the valve shaft.

With the electromagnetically driven valve thus configured, leakage of a magnetic flux toward the valve shaft can be prevented, because the nonmagnetic body is arranged between the oscillating member and the valve shaft. Thus, it is possible to provide the compact electromagnetically driven valve where sufficient electromagnetic force can be obtained.

A second aspect of the invention relates to an electromagnetically driven valve that is driven by electromagnetic force. The electromagnetically driven valve includes a valve element that has a valve shaft and that reciprocates in the direction in which the valve shaft extends; and a oscillating member that extends from a driving end, which is operatively linked with the valve shaft, to a pivoting end, and that pivots around a central axis which extends along the pivoting end. A portion of the driving end, which is operatively linked with the valve shaft, of the oscillating member projects with respect to the other portion of the driving end in the direction in which the oscillating member extends from the pivoting end to the driving end. With the electromagnetically driven valve thus configured, because the projection portion is used as a linked portion of the oscillating member, which is operatively linked with the valve shaft, a magnetic circuit is not interfered with by the linked portion. As a result, the area of a flux path is sufficiently reserved, thereby increasing the electromagnetic force. In addition, the size of the electromagnetically driven valve can be reduced.

The invention thus provides the electromagnetically driven valve that is both high-powered and compact.

BRIEF DESCRIPTION OF THE DRAWINGS

The foregoing and further objects, features and advantages of the invention will become apparent from the following description of example embodiments with reference to the accompanying drawings, wherein the same or corresponding portion are denoted by the same reference numerals and wherein.

DETAILED DESCRIPTION OF THE EXAMPLE EMBODIMENTS

Figure 1:
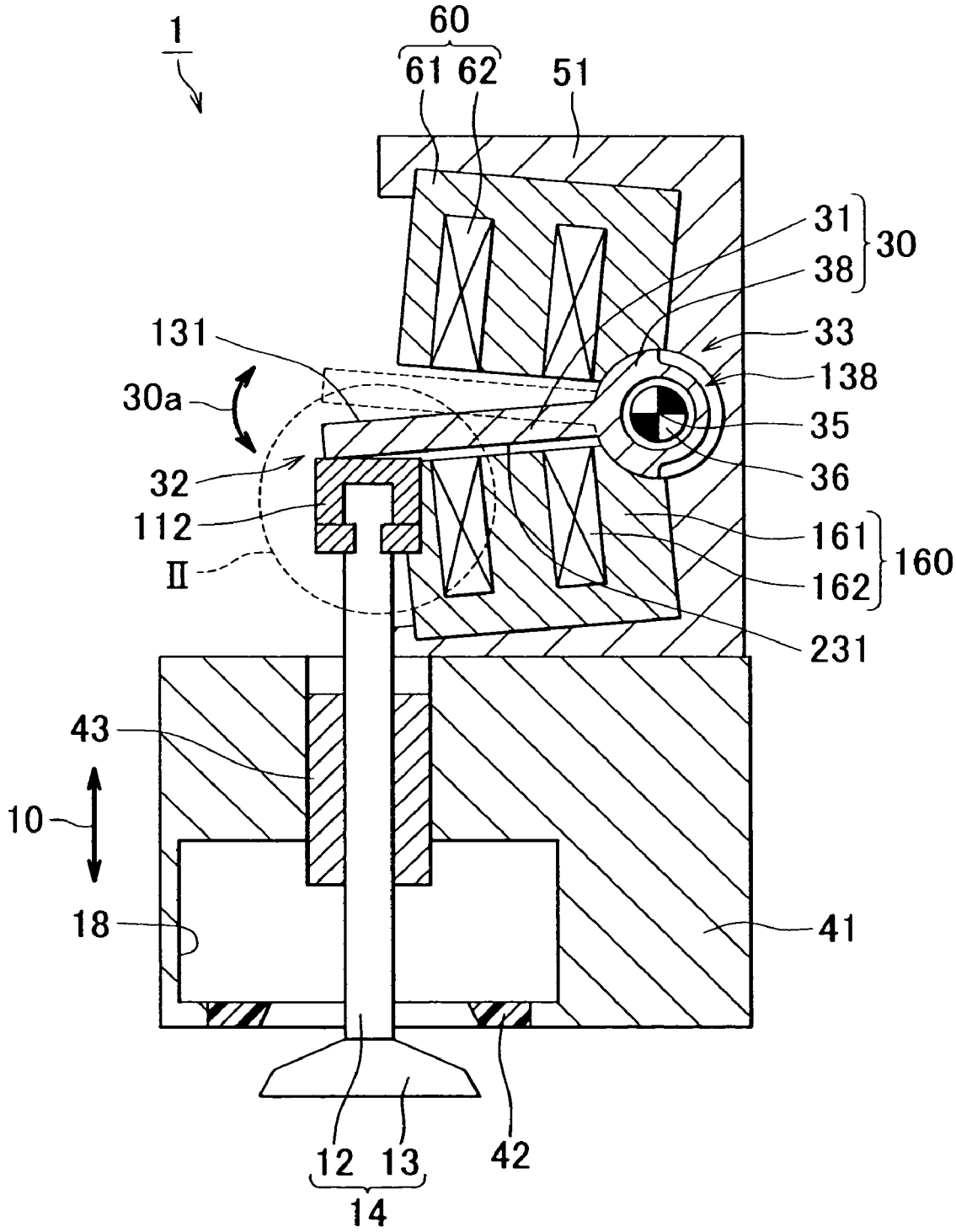
FIG. 1 illustrates the cross-sectional view of an electromagnetically driven valve according to a first embodiment of the invention.

Hereafter, example embodiments of the invention will be described with reference to accompanying drawings. In the embodiments, the same or corresponding portions will be denoted by the same reference numerals, and will be described only once.

First Embodiment

FIG. 1 illustrates the cross-sectional view of an electromagnetically driven valve according to a first embodiment of the invention. As shown in FIG. 1, an electromagnetically driven valve 1 includes a main body 51; an upper electromagnet 60 and a lower electromagnet 160 that are both fitted to the main body 51; a disc 30 that is arranged between the upper electromagnet 60 and the lower electromagnet 160; and a valve element 14 that is driven by the disc 30.

The U-shaped main body 51 is a base member. Various components are fitted to the main body 51. The upper electromagnet 60 has a core 61 made of magnetic material, and a coil 62 wound around the core 61. Similarly, the lower electromagnet 160 has a core 161 and a coil 162 wound around the core 161. Application of an electric current to the coils 62, 162 produces a magnetic field that drives the disc 30. The disc 30 is arranged between the upper electromagnet 60 and the lower electromagnet 160. The disc 30 is attracted to either the upper electromagnet 60 or the lower electromagnet 160 by the attraction force of the electromagnet. Thus, the disc 30 reciprocates between the upper electromagnet 60 and the lower electromagnet 160. The reciprocation of the disc 30 is transmitted to a valve stem 12.

The electromagnetically driven valve 1 is driven by electromagnetic force. The electromagnetically driven valve 1 is provided with the valve element 14 that includes the valve stem 12 serving as a valve shaft and that reciprocates in the direction in which the valve stem 12 extends (in the direction of an arrow 10); the disc 30 serving as a oscillating member that extends from a driving end 32, which is operatively linked with the valve stem 12, to a pivoting end 33, and that pivots around a central axis which extends along the pivoting end; and a nonmagnetic body 112 that is arranged between the disc 30 and the valve stem 12. The electromagnetically driven valve 1 according to the first embodiment is provided with a mechanism (not shown) that is used to lift the valve element 14. The mechanism that lifts the valve element 14 may be formed, for example, by fitting a pin, which is provided to the nonmagnetic body 112 or the valve stem 12, into a long hole formed at the driving end of the disc 30.

The electromagnetically driven valve 1 according to the first embodiment is used as either an intake valve or an exhaust valve of an internal combustion engine such as a gasoline engine or a diesel engine. In the first embodiment, the valve element 14 is used as an intake valve arranged at an intake port 18. However, the invention may be applied to a valve element serving as an exhaust valve.

The electromagnetically driven valve 1 is a pivot-type electromagnetically driven valve. The disc 30 is used as a motion mechanism of the electromagnetically driven valve 1. The main body 51 is arranged on a cylinder head 41. The lower electromagnet 160 is arranged at the lower portion of the main body 51, and the upper electromagnet 60 is arranged at the upper portion of the main body 51. The lower electromagnet 160 has the core 161 made of iron and the coil 162 wound around the core 161. When an electric current is applied to the coil 162, a magnetic field is produced around the coil 162. Using the magnetic field, the lower electromagnet 160 attracts the disc 30. The upper electromagnet 60 has the core 61 made of iron and the coil 62 wound around the core 61. When an electric current is applied to the coil 62, a magnetic field is produced around the coil 62. Using the magnetic field, the upper electromagnet 60 attracts the disc 30.

The coil 62 of the upper electromagnet 60 and the coil 162 of the lower electromagnet 160 may be connected to each other. Alternatively, the coil 62 of the upper electromagnet 60 and the coil 162 of the lower electromagnet 160 may be separated from each other. The number of turns of each of the coil 62 wound around the core 61 and the coil 162 wound around the core 161 is not limited.

The disc 30 has an arm portion 31 and a bearing portion 38. The arm portion 31 extends from the driving end 32 to the pivoting end 33. The arm portion 31 is attracted alternately to the upper electromagnet 60 and the lower electromagnet 160, thereby oscillating (pivoting) in the direction of an arrow 30*a*. The bearing portion 38 is fitted to the end portion of the arm portion 31. The arm portion 31 pivots around the bearing portion 38. An upper surface 131 of the arm portion 31 can contact the upper electromagnet 60, and a lower surface 231 can contact the lower electromagnet 160. Also, the lower surface 231 contacts the nonmagnetic body 112.

The bearing portion 38 has a cylindrical shape. A torsion bar 36 is housed in the cylindrical bearing portion 38. A first end portion of the torsion bar 36 is splined to the main body 51, and a second end portion of the torsion bar 36 is fitted to the bearing portion 38. With this structure, when the bearing portion 38 starts rotating, the torsion bar 36 applies a urging force against the pivot to the bearing portion 38. Thus, an urging force is always applied to the bearing portion 38 to urge the disc 30 to the neutral position.

At the driving end 32, the disc 30 presses the valve stem 12 via the nonmagnetic body 112. The valve stem 12 is guided by a stem guide 43.

The main body 51 is fixed to a cylinder head 41. The intake port 18 is formed in the lower portion of the cylinder head 41. The intake port 18 is used as a passage through which intake air is introduced into a combustion chamber. An air-fuel mixture or air flows through the intake port 18. A valve seat 42 is provided between the intake port 18 and the combustion chamber, thereby improving sealability of the valve element 14.

The valve element 14 serving as an intake valve is fitted to the cylinder head 41. The valve element 14 has the valve stem 12 that extends in the longitudinal direction, and a bell portion 13 that is fitted to the end portion of the valve stem 12. The valve element 14 can reciprocate in the direction of the arrow 10.

Figure 2:
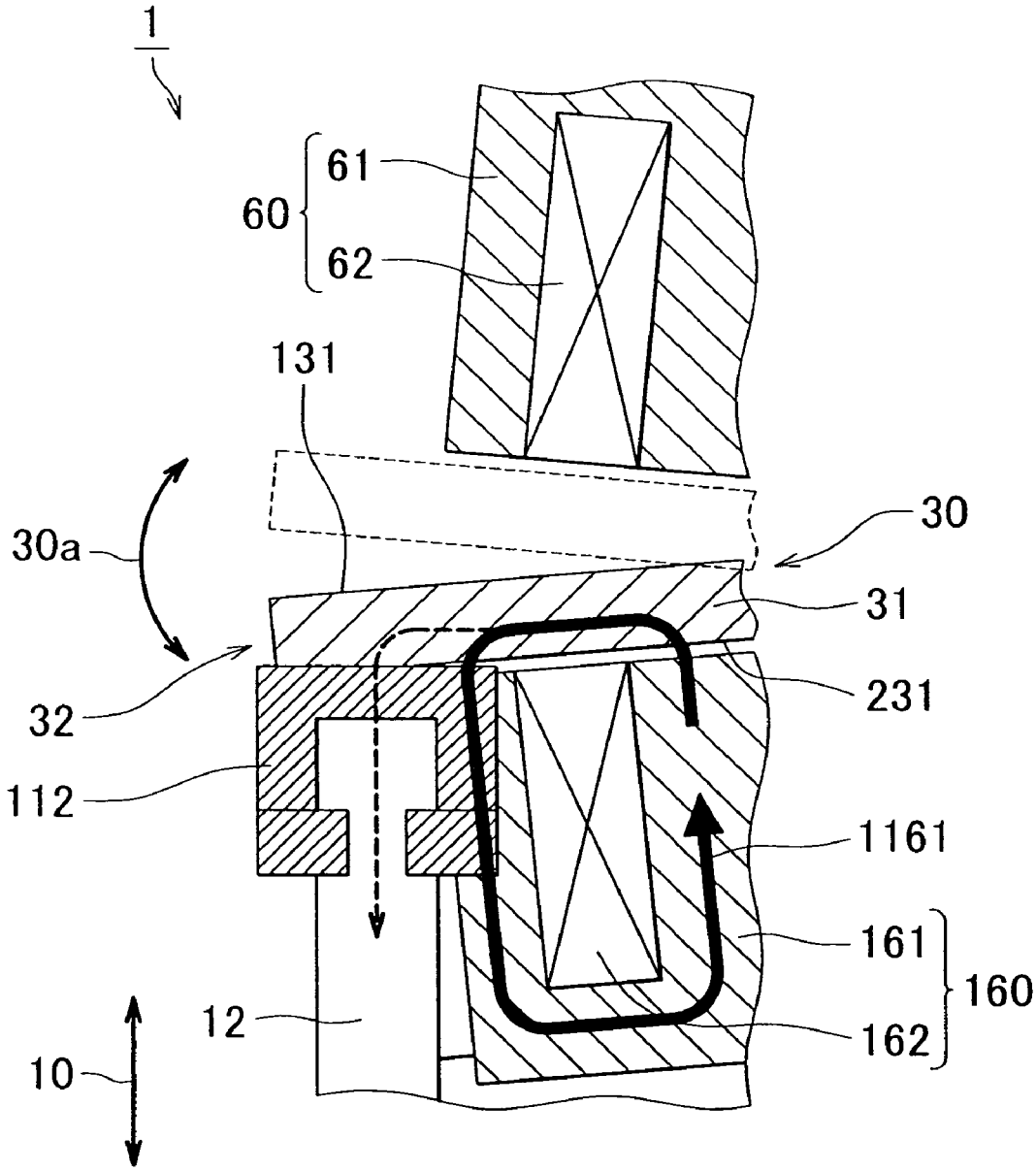
FIG. 2 illustrates the enlarged cross-sectional view of a portion circled by the dotted line II in FIG. 1.

FIG. 2 illustrates the enlarged cross-sectional view of the portion circled by the dotted line II in FIG. 1. When an electric current is applied to the coil 162, a magnetic circuit 1161 is produced as shown by the arrow. If there is no leakage of a magnetic flux forming the magnetic circuit 1161, a great amount of electromagnetic force is obtained, and the arm portion 31 of the disc 30 can be attracted to the lower electromagnet 160 with a strong force. The nonmagnetic body 112 serving as a magnetic barrier prevents leakage of the magnetic flux to the outside. Namely, as shown in the arrow with dotted line, if the magnetic flux leaks toward the valve stem 12, the electromagnetic force is reduced. According to the first embodiment, however, leakage of the magnetic flux can be prevented, because the nonmagnetic body 112 made, for example, of SUS material (stainless steel) is provided at the driving end 32 so as to cover the valve stem 12. As shown in FIG. 2, the nonmagnetic body 112 covers the top portion of the valve stem 12, and has a shape of a cap. According to the first embodiment, because a member that transmits a force from the end of the disc 30 to the valve stem 12 is formed of the nonmagnetic body 112, the leakage flux is reduced, the electromagnetic force is increased, and power consumption is reduced.

Next, the operation of the electromagnetically driven valve 1 according to the first embodiment will be described. To drive the electromagnetically driven valve 1, first, an electric current is applied to either the coil 62 of the upper electromagnet 60 or the coil 162 of the lower electromagnet 160. For example, in the first embodiment, an electric current is applied to the coil 62. Thus, a magnetic field is produced at the coil 62, and the arm portion 31 of the disc 30, which is made of magnetic material, is attracted to the upper electromagnet 60. When the arm portion 31 moves upward, the torsion bar 36 is twisted, and starts to move the arm portion 31 downward. However, because the attraction force of the upper electromagnet 60 is strong, the arm portion 31 moves upward, and, finally, the upper surface 131 of the arm portion 31 contacts the upper electromagnet 60. As the arm portion 31 moves upward, the nonmagnetic body 112 and the valve stem 12 also move upward. Thus, the valve element 14 is closed.

To open the valve element 14, the arm portion 31 needs to be moved downward. In this case, first, application of an electric current to the coil 62 is stopped, or the amount of electric current applied to the coil 62 is reduced. Thus, the electromagnetic force acting between the upper electromagnet 60 and the arm portion 31 is reduced. Because a torsion force is applied to the arm portion 31 by the torsion bar 36, the torsion force (elastic force) exceeds the electromagnetic force, and the arm portion 31 moves to the neutral position in FIG. 1. Next, an electric current is applied to the coil 162 of the lower electromagnet 160. Thus, a magnetic field is produced around the coil 162, and the arm portion 31 made of magnetic material is attracted to the lower electromagnet 160. At this time as well, the valve stem 12 of the valve element 14 is pressed by the arm portion 31 to move downward. The attraction force of the coil 162 exceeds the torsion force of the torsion bar 36, and, therefore, the lower surface 231 of the disc 30 contacts the lower electromagnet 160. As the valve stem 12 moves downward, the valve element 14 also moves downward and opens.

The arm portion 31 reciprocates in the direction of the arrow 30*a* by repeatedly performing the above-described upward movement and downward movement. As the arm portion 31 reciprocates, the bearing portion 38 connected to the arm portion 31 pivots.

In the electromagnetically driven valve 1 thus configured according to the first embodiment, leakage of magnetic flux is prevented by the nonmagnetic body 112, the electromagnetic force is increased, the power consumption is reduced, and an increase in size is avoided.

Second Embodiment

Figure 3:
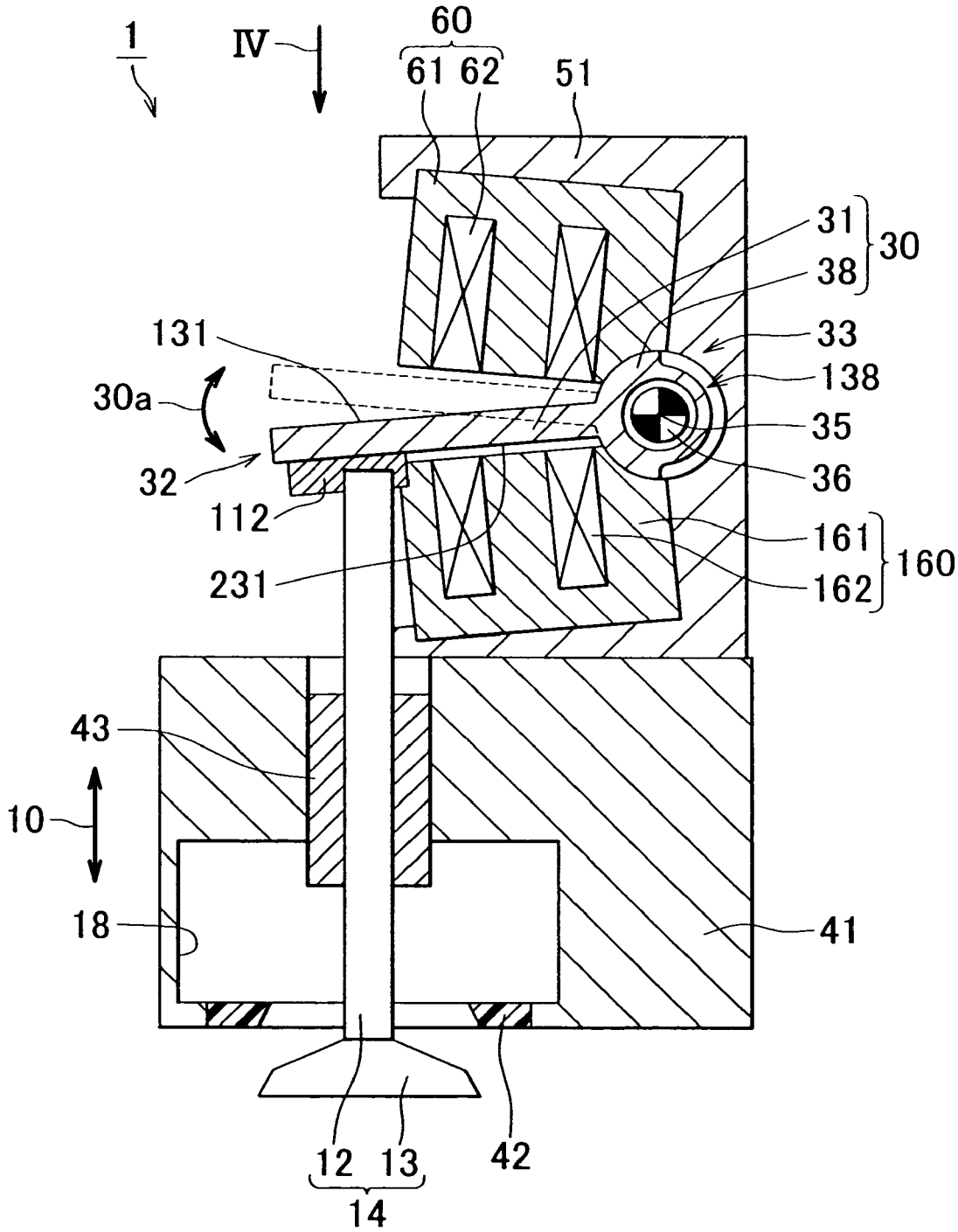
FIG. 3 illustrates the cross-sectional view of an electromagnetically driven valve according to a second embodiment of the invention.
Figure 4:
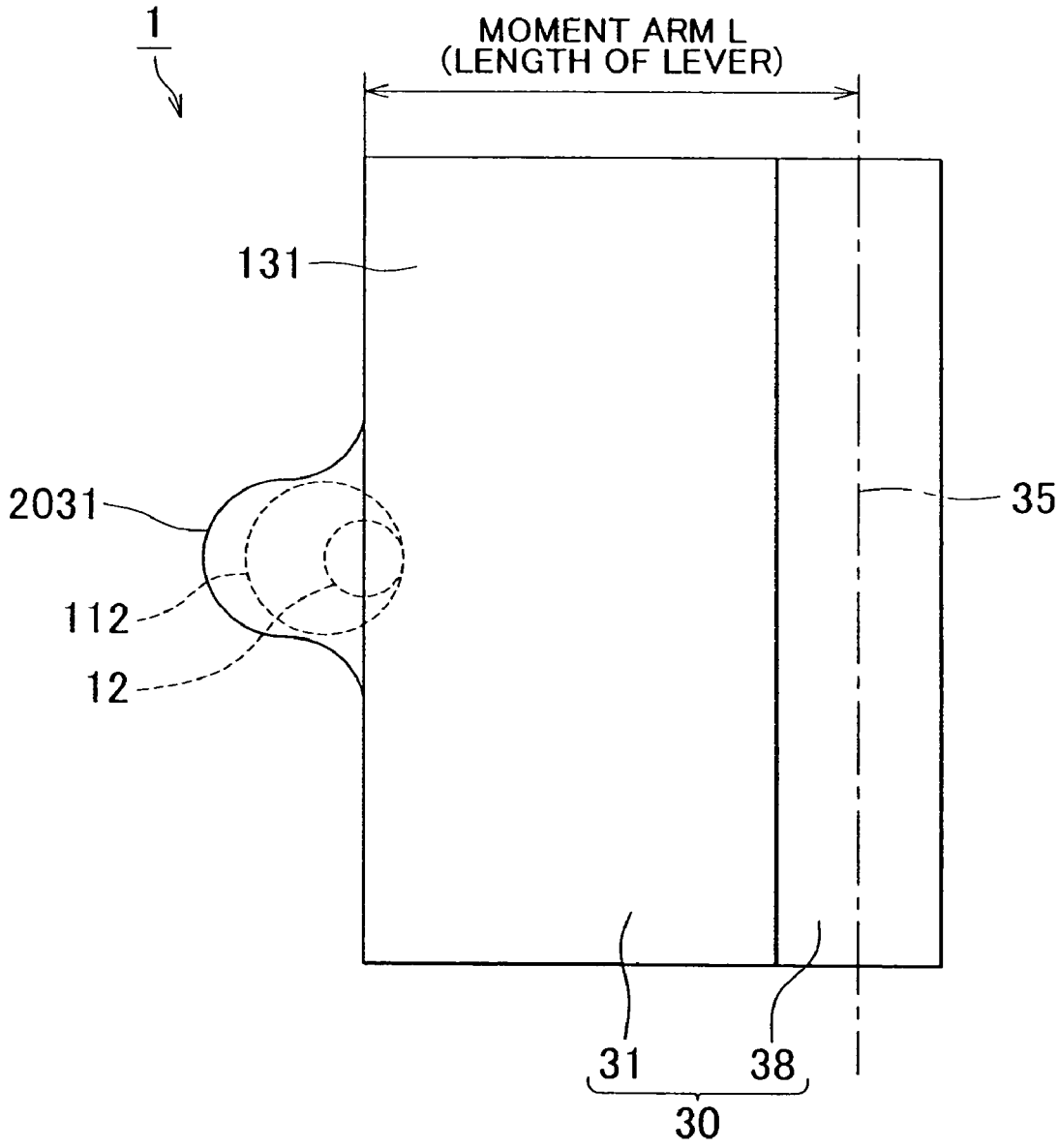
FIG. 4 illustrates the plan view of a disc viewed from the direction of an arrow IV.

FIG. 3 illustrates the cross-sectional view of an electromagnetically driven valve according to a second embodiment. FIG. 4 illustrates the plan view of the electromagnetically driven valve viewed from the direction of an arrow IV in FIG. 3. As shown in FIGS. 3 and 4, in the electromagnetically driven valve 1 according to the second embodiment, a projection portion 2031 is provided to the disc 30, and the projection portion 2031 presses the valve stem 12 via the nonmagnetic body 112. The projection portion 2031 is a part of the arm portion 31, and is positioned at substantially the center of the arm portion 31 in the direction in which a central axis 35 serving as a rotational axis extends. The projection portion 2031 projects from the driving end of the arm portion 31 in the direction in which the arm portion 31 extends from the pivoting end to the driving end. The electromagnetically driven valve 1 according to the second embodiment is driven by electromagnetic force. The electromagnetically driven valve 1 is provided with the valve element 14 that includes the valve stem 12 and that reciprocates in the direction in which the valve stem 12 extends; and the disc 30 that extends from the driving end 32, which is operatively linked with the valve stem 12, to the pivoting end 33 and that pivots around the central axis 35 which extends along the pivoting end. The projection portion 2031 of the disc 30, which is operatively linked with the valve stem 12, projects from the driving end of the arm portion 31 in the direction in which the arm portion 31 extends from the pivoting end to the driving end.

A length L from the central axis 35 to the end face at the driving end of the arm portion 31, other than the projection portion 2031, is sufficiently long. The area of the portion at which the upper surface 131 faces the upper electromagnet 60 is correlated with the force with which the upper electromagnet 60 attracts the disc 30. As the area increases, the force with which the upper electromagnet 60 attracts the disc 30 increases. In the second embodiment, the portion that transmits force from the arm portion 31 to the valve stem 12 is provided on the outer side of the arm portion 31. Thus, the valve stem 12 can be arranged without interfering with the magnetic circuit of the upper electromagnet 60, whereby a sufficient area of a flux path can be reserved. As a result, the electromagnetic force is increased, and the amount of electric current used and power consumption are both reduced.

Third Embodiment

Figure 5:
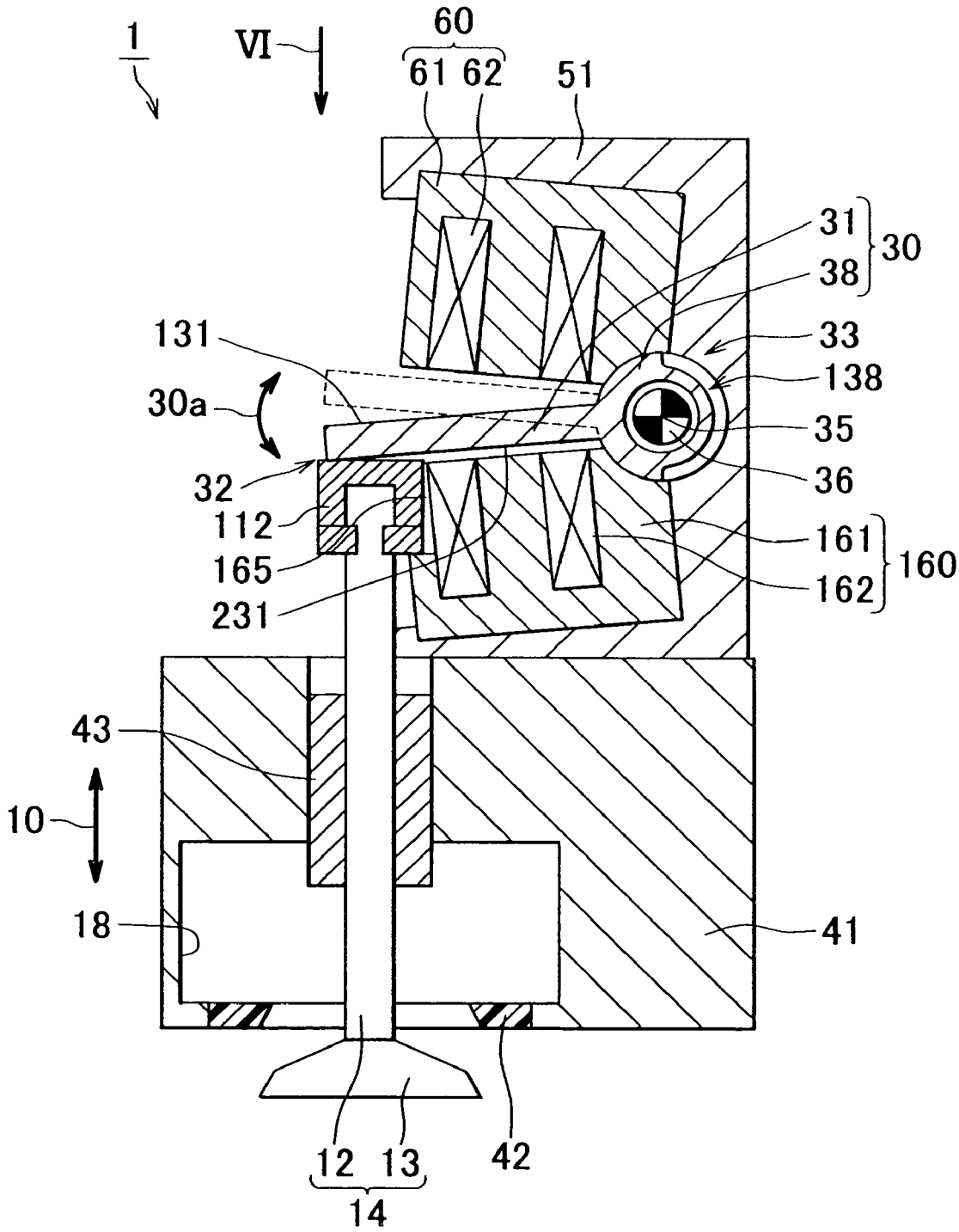
FIG. 5 illustrates the cross-sectional view of an electromagnetically driven valve according to a third embodiment of the invention.
Figure 6:
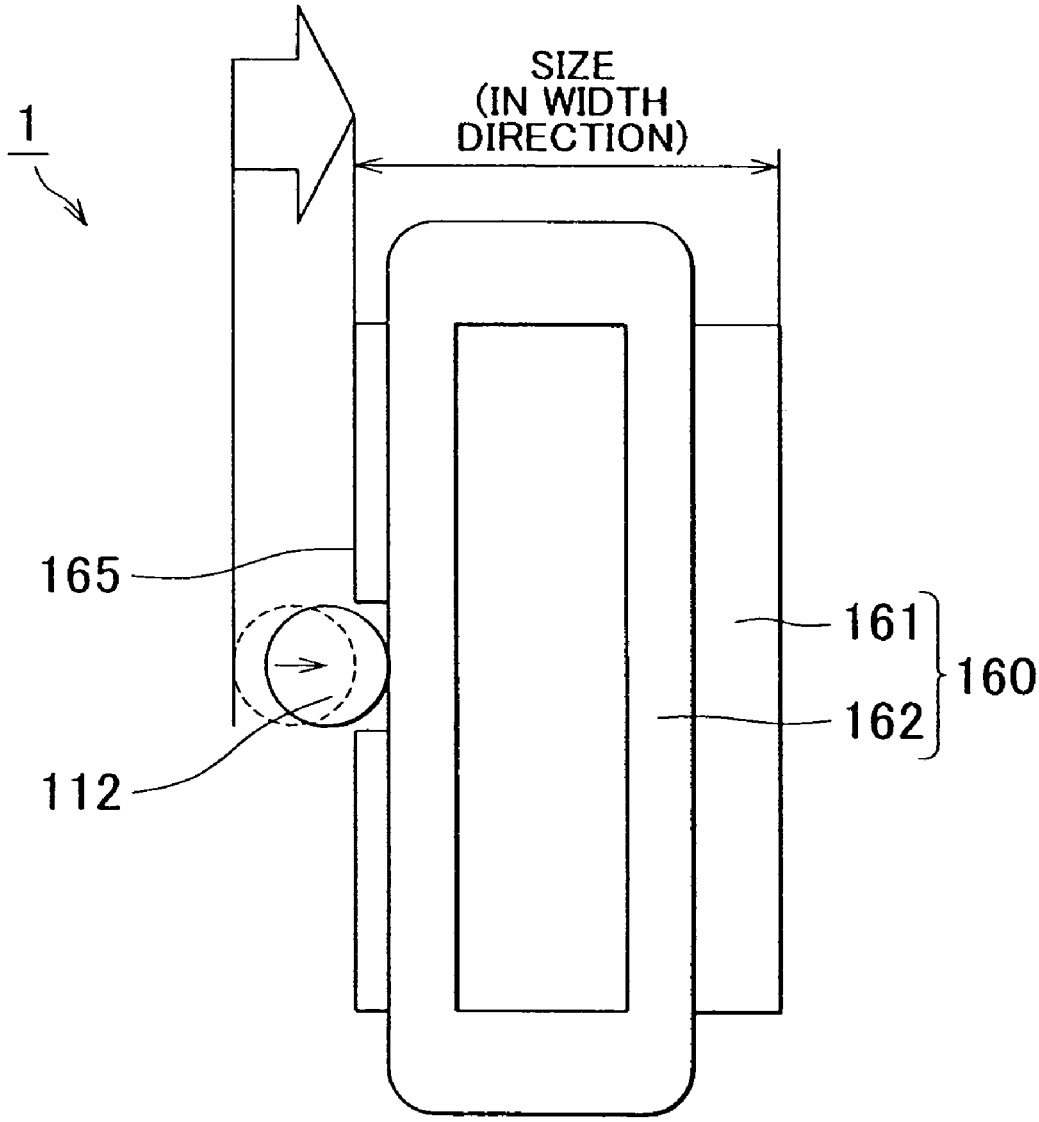
FIG. 6 illustrates the plan view of a lower electromagnet viewed from the direction of an arrow VI.

FIG. 5 illustrates the cross-sectional view of an electromagnetically driven valve according to a third embodiment. FIG. 6 illustrates the plan view of the lower electromagnet viewed from the direction of an arrow VI in FIG. 5. As shown in FIGS. 5 and 6, the electromagnetically driven valve 1 according to the third embodiment differs from the electromagnetically driven valve 1 according to the first embodiment in that a concave portion 165, which is a notch, is formed in the core 161 of the lower electromagnet 160. The concave portion 165 is formed, as a recess portion, in a part of the core 161 formed by laminating magnetic steel sheets. The concave portion 165 is formed by forming the notch extending from the end surface, on the driving end 32 side, toward the end surface, on the pivoting end 33 side, of the core 161. The concave portion 165 reaches the position where the coil 162 is located. The valve stem 12 and the nonmagnetic body 112 are provided at the concave portion 165, and the nonmagnetic body 112 and the valve stem 12 vertically reciprocate in the concave portion 165. Namely, the recess portion is formed in the core 161 formed by laminating magnetic steel sheets, and the valve stem 12 is arranged at the recess portion.

The electromagnetically driven valve thus configured according to the third embodiment is provided with the lower electromagnet 160 that drives the disc 30. The lower electromagnet 160 has the core 161 made of magnetic material and the coil 162 wound around the core 161. The concave portion 165 is formed by forming the notch, extending toward the pivoting end 33, in a part of the core 161 on the driving end 32 side. In the lower electromagnet 160, the valve stem 12 is arranged at the concave portion 165.

With the electromagnetically driven valve 1 thus configured according to the third embodiment, the size can be reduced in the width direction, that is, the direction in which the disc 30 extends from the driving end to the pivoting end. As a result, the size of the electromagnetically driven valve 1 can be reduced.

Fourth Embodiment

Figure 7:
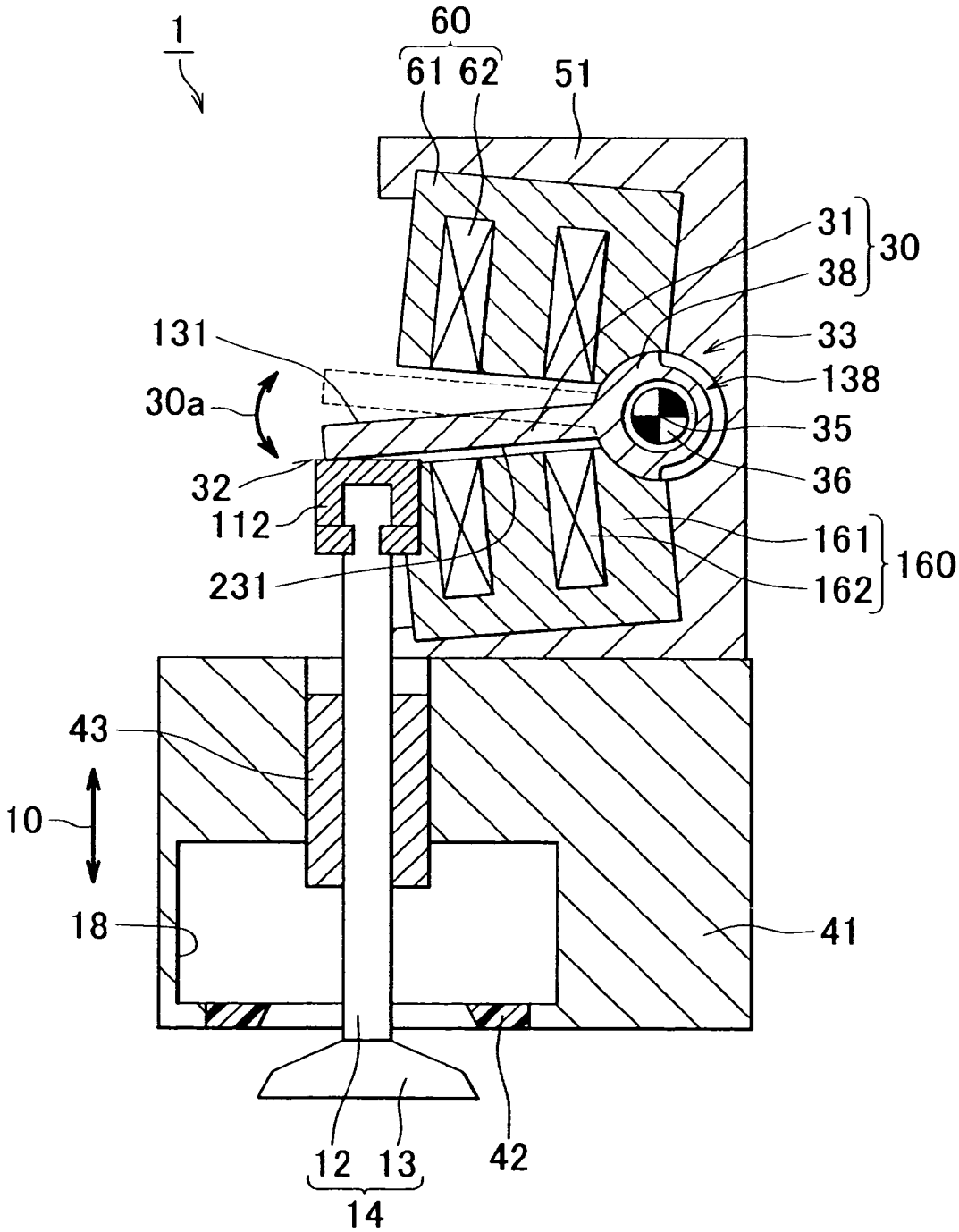
FIG. 7 illustrates the cross-sectional view of an electromagnetically driven valve according to a fourth embodiment of the invention.
Figure 8:
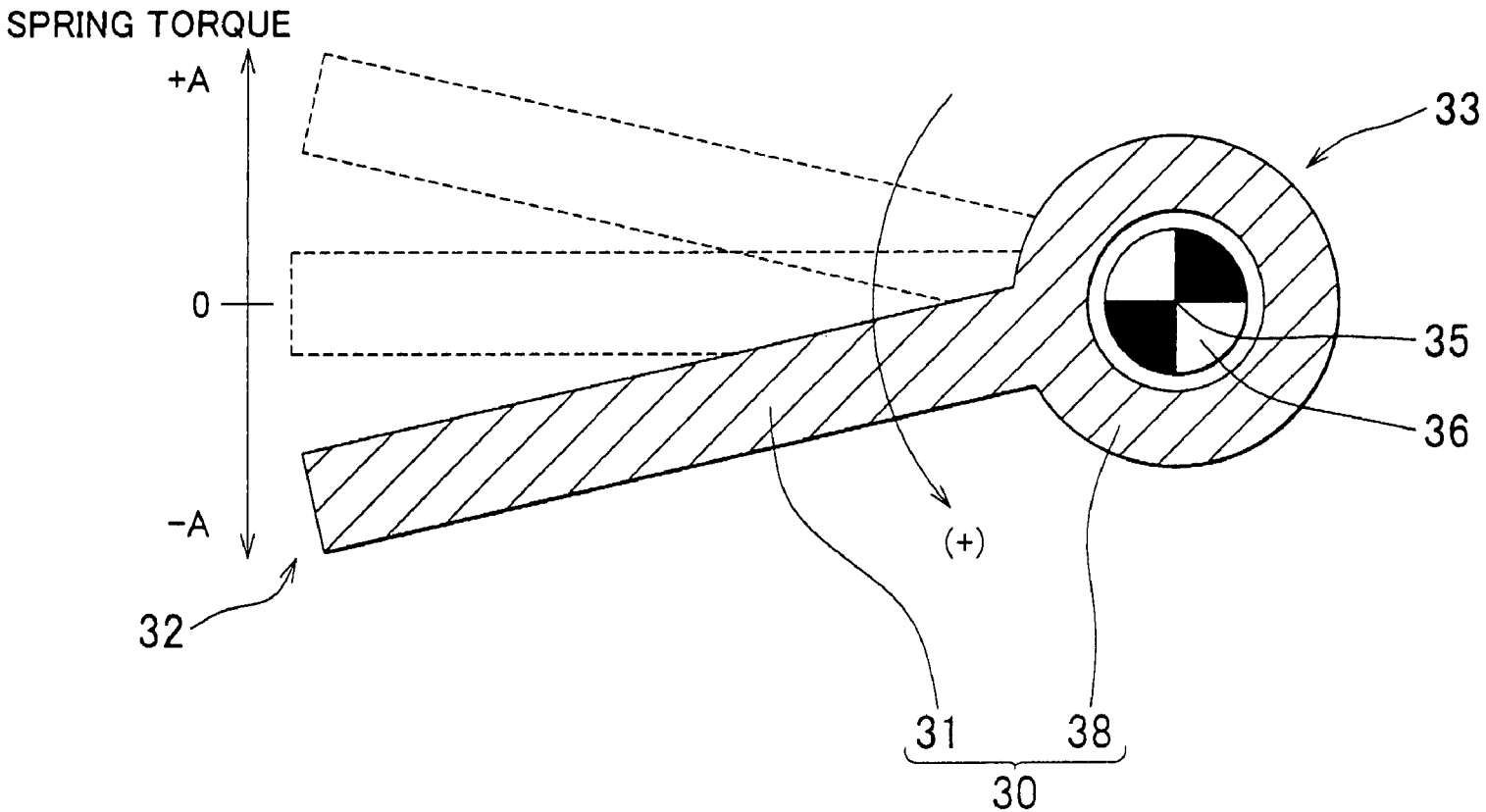
FIG. 8 illustrates the enlarged cross-sectional view of a disc in FIG. 7.

FIG. 7 illustrates the cross-sectional view of an electromagnetically driven valve according to a fourth embodiment of the invention. FIG. 8 illustrates the enlarged cross-sectional view of the disc in FIG. 7. As shown in FIGS. 7 and 8, in the electromagnetically driven valve 1 according to the fourth embodiment, the position of the disc 30 at which no load is generated by the torsion bar 36 is set to the neutral position of the disc 30 or a position near the neutral position. Therefore, the height of the electromagnetically driven valve 1 is reduced because a spring for driving the valve element 14 is no longer required. As a result, the size of the electromagnetically driven valve 1 can be reduced. Namely, as shown in FIG. 8, when the torsion bar 36 is twisted due to an pivoting of the disc 30, spring torque fluctuates within the range from +A to −A. Namely, the electromagnetically driven valve 1 according to the first embodiment further includes the torsion bar 36 that supports the disc 30. The position of the disc 30 at which no load is generated by the torsion bar 36 substantially corresponds to the neutral position of the disc 30 (the middle point between the upper electromagnet 60 and the lower electromagnet 160). The electromagnetically driven valve 1 thus configured according to the fourth embodiment produces the same effects as those of the electromagnetically driven valve 1 according to the first embodiment.

Fifth Embodiment

Figure 9:
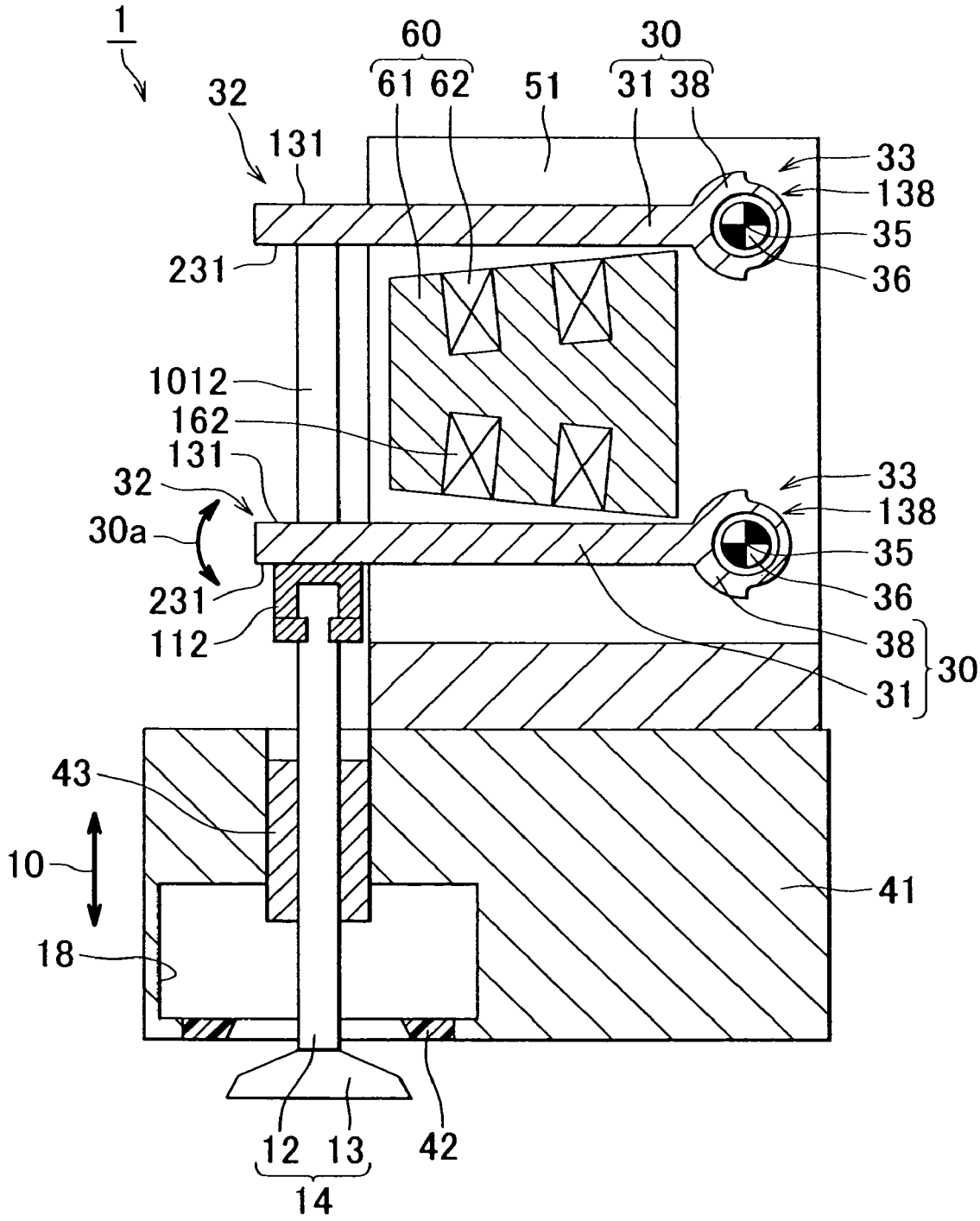
FIG. 9 illustrates the cross-sectional view of an electromagnetically driven valve according to a fifth embodiment of the invention.

FIG. 9 illustrates the cross-sectional view of an electromagnetically driven valve according to a fifth embodiment. As shown in FIG. 9, the electromagnetically driven valve 1 according to the fifth embodiment differs from the electromagnetically driven valve according to the first embodiment, in that two discs 30, that are, the upper disc 30 and the lower disc 30, are provided. The upper disc 30 and the lower disc 30 are connected to each other by a stem 1012. The nonmagnetic body 112 is arranged between the lower disc 30 and the valve stem 12.

The electromagnetically driven valve 1 thus configured according to the fifth embodiment produces the same effects as those of the electromagnetically driven valve 1 according to the first embodiment.

While the embodiments of the inventions has been described, various modifications may be made to the embodiments. In the first to fourth embodiments, one disc 30 is used. However, as in the fifth embodiment, two discs 30 may be used.

The coil 62 of the upper electromagnet 60 and the coil 162 of the lower electromagnet 160 may be formed of a single coil. However, the coil 62 and the coil 162 may be formed of separate coils, and may be individually controlled.

The embodiments of the invention that have been disclosed in the specification are to be considered in all respects as illustrative and not restrictive. The technical scope of the invention is defined by claims, and all changes which come within the meaning and range of equivalency of the claims are therefore intended to be embraced therein.

For example, the invention may also be used in a field of an electromagnetically driven valve for an internal combustion engine mounted in a vehicle.

What is claimed is:

1. An electromagnetically driven valve that is driven by electromagnetic force, comprising:

a valve element that has a valve shaft and that reciprocates in a direction in which the valve shaft extends;

a oscillating member that extends from a driving end, which is operatively linked with the valve shaft, to a pivoting end, and that pivots around a central axis which extends along the pivoting end;

a nonmagnetic body that is arranged between the oscillating member and the valve shaft;

an electromagnet that drives the oscillating member having a core made of magnetic material and a coil wound around the core; and a concave portion formed by cutting a part of the core from the driving end toward the pivoting end, wherein the valve shaft and the nonmagnetic body are arranged at the concave portion.

2. The electromagnetically driven valve according to claim 1, wherein a center portion of the driving end, which is operatively linked with the valve shaft, of the oscillating member projects with respect to the other portion of the driving end in a direction in which the oscillating member extends from the pivoting end to the driving end, the center portion being at a center of the driving end in a direction in which the central axis extends.

3. The electromagnetically driven valve according to claim 1, further comprising:

a torsion bar that supports the oscillating member, wherein a position of the oscillating member at which no load is generated by the torsion bar substantially corresponds to a neutral position of the oscillating member.

4. The electromagnetically driven valve according to claim 1, wherein the nonmagnetic body arranged between the oscillating member and the valve shaft is made of SUS material.

5. The electromagnetically driven valve according to claim 1, wherein:

the oscillating member includes a first oscillating member and a second oscillating member;

a stem that connects a driving end, which is operatively linked with the valve shaft, of the first oscillating member to a driving end of the second oscillating member is provided; and an electromagnet is arranged between the first oscillating member and the second oscillating member.

6. The electromagnetically driven valve according to claim 1, wherein the electromagnetically driven valve is used as at least one of an intake valve and an exhaust valve of an internal combustion engine mounted in a motor vehicle.

7. The electromagnetically driven valve according to claim 1, wherein the electromagnet includes:

a lower electromagnet that attracts the oscillating member to open the valve element; and an upper electromagnet that attracts the oscillating member to close the valve element.

8. The electromagnetically driven valve according to claim 7, further comprising:

a torsion bar that supports the oscillating member, wherein a position of the oscillating member at which no load is generated by the torsion bar substantially corresponds to a middle point between the upper electromagnet and the lower electromagnet.

9. The electromagnetically driven valve according to claim 1, wherein the concave portion is formed by cutting the part of the core, at which the valve shaft contacts the core.

* * * * *